United States Patent [19]

Ziebart

[11] 4,037,279

[45] July 26, 1977

[54] WATER SKI

[76] Inventor: Herbert F. Ziebart, 6981 Deepwater Point Road, Rte. 2, Williamsburg, Mich. 49690

[21] Appl. No.: 623,430

[22] Filed: Oct. 17, 1975

[51] Int. Cl.[2] ..... A63C 15/00

[52] U.S. Cl. ..... 9/310 A; 114/127

[58] Field of Search ..... 114/126, 127, 152, 162, 114/163, 164, 140; 9/310 A, 310 B, 310 C, 310 D, 310 E, 310 R, 310 F; 160/369, 371, 373; 49/504

[56] References Cited

U.S. PATENT DOCUMENTS

| | | | |
|---|---|---|---|
| 2,906,327 | 9/1959 | Crumley et al. | 160/369 |
| 3,082,444 | 3/1963 | Estes | 9/310 A |
| 3,564,632 | 2/1971 | Bahne, Jr. | 9/310 E |

FOREIGN PATENT DOCUMENTS

| | | | |
|---|---|---|---|
| 458,506 | 3/1928 | Germany | 114/127 |

*Primary Examiner*—Trygve M. Blix
*Assistant Examiner*—Gregory W. O'Connor
*Attorney, Agent, or Firm*—Barnes, Kisselle, Raisch & Choate

[57] ABSTRACT

A water ski comprising a water ski body having a forward end, a rear end, a top side and a bottom side, and a fin extending downwardly from the bottom side, wherein the fin has an elastic portion movable laterally of the water ski body under the action of water.

4 Claims, 4 Drawing Figures

WATER SKI

This invention relates to water skis.

BACKGROUND OF THE INVENTION

In recent times, the sport of water skiing has become extremely popular. In an effort to provide greater stability to the water skis, it has been suggested that fins or similar elements be provided on the bottom side of the water ski.

Among the objects of the invention are to provide an improved water ski having a fin construction which provides a more stable, safe water ski; wherein the water ski has improved performance; and which can be readily adapted to water skis that are presently available.

SUMMARY OF THE INVENTION

The water ski embodying the invention comprises a water ski body having a forward end, a rear end, a top side and a bottom side, a fin extending downwardly from the bottom side; the fin having an elastic portion movable laterally of the water ski body under the action of water.

DESCRIPTION

Figure 1:
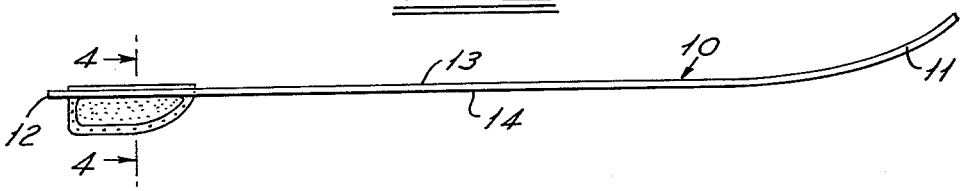
FIG. 1 is a side elevational view of a water ski embodying the invention.
Figure 2:
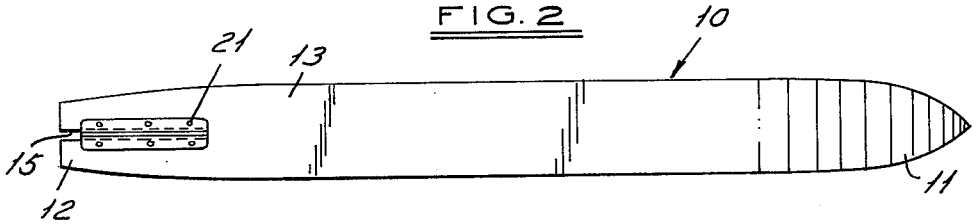
FIG. 2 is a plan view of the same.
Figure 3:
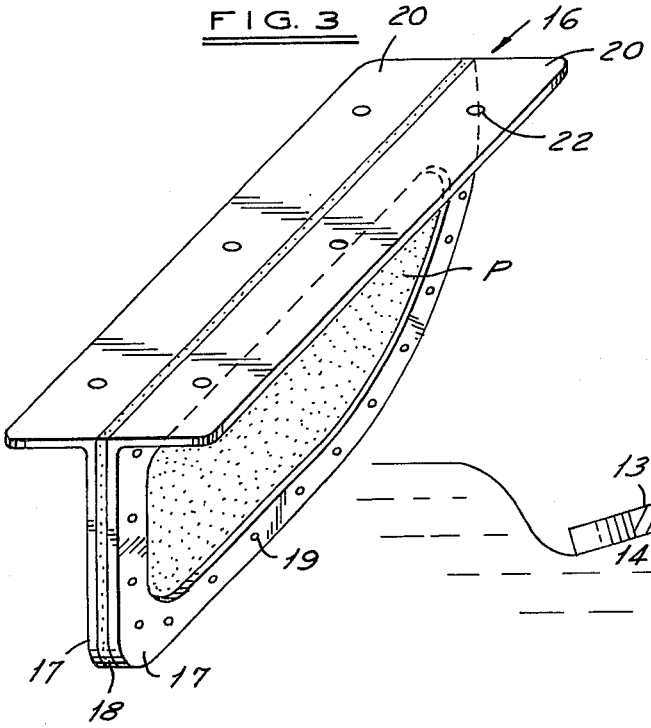
FIG. 3 is a perspective view of the fin removed from the water ski.

Referring to FIG. 1, the water ski embodying the invention comprises a body 10 which is of generally conventional construction including a forward end 11, a rear end 12, a top side 13 and a bottom side 14.

A slot 15 is provided at the rear end 12 and extends generally longitudinally of the body 10. A fin structure 16 is provided in the slot and is spaced forwardly of the rear and extends longitudinally of the ski body. The fin structure 16 comprises frame elements 17 between which an elastic sheet 18 of substantially uniform thickness and made of appropriate material such as rubber is clamped by rivets or other suitable fasteners 19. The frame elements 17 include flanges 20 extending laterally from the upper end thereof that engage the top side 13 of the water ski. Screws 21 extend through openings 22 to fasten the fin in position on the water ski.

Figure 4:
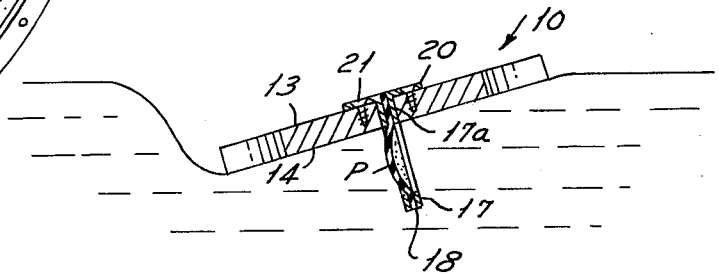
FIG. 4 is a partly diagrammatic sectional view taken along the line 4—4 showing the manner in which the water ski functions.

Each of the frame elements 17 is of generally uniform width to surround and leave exposed the central portion P of the sheet 18. As shown in FIG. 4, the uppermost portion of the frame 17 has its lower edge substantially coextensive with the underside 14 of the water ski.

When a water skier having the skis 10 thereon is moving along the water, the elastic material tends to bulge out and forms a pocket when the skier turns and goes into a lean. Thus, for example, as shown in FIG. 4, when the skier turns and leans to the left, the bulge is formed in the central portion P, tending to expose a greater area to come into contact with the water so that greater traction is achieved. Thus, the water skis have improved leaning, turning, and cornering ability, providing a safer, more controllable water ski.

The size and shape of the central portion P can be adjusted to the individual requirements of a water skier and the desired angle, speed, weight, height, cornering and turning techniques.

When the water skier is moving forwardly in a straight line without cornering or leaning, central portion P will not bulge.

I claim:

1. In a water ski, the combination comprising
a water ski body having a forward end, a rear end, a top side and a bottom side,
a fin extending downwardly from the bottom side,
said fin comprising two spaced frames and an elastic element interposed between said frames and defining an elastic portion of substantially uniform thickness movable laterally of the water ski body under the action of water,
said water ski body including a longitudinally extending slot,
said frames extending through said slot,
said frame elements having flanges integral therewith and engaging the top side of said water ski.

2. In a water ski, the combination comprising
a water ski body having a forward end, a rear end, a top side and a bottom side,
a fin extending downwardly from the bottom side,
said fin having an elastic portion movable laterally of the water ski body under the action of water,
said fin comprising two spaced frames and an elastic element interposed between said frames and defining said elastic portion.

3. The combination set forth in claim 2 wherein said water ski body includes a longitudinally extending slot, said frame extending through said slot.

4. The combination set forth in claim 3 wherein said frame elements have flanges integral therewith and engaging the top side of said water ski.

* * * * *